US006796403B1

(12) United States Patent
Laughlin

(10) Patent No.: US 6,796,403 B1
(45) Date of Patent: Sep. 28, 2004

(54) EXHAUST SYSTEM BAFFLING APPARATUS

(76) Inventor: James C. Laughlin, 5085 Kennard Rd., P.O. Box 469, Seville, OH (US) 44273

( * ) Notice: Subject to any disclaimer, the term of this patent is extended or adjusted under 35 U.S.C. 154(b) by 52 days.

(21) Appl. No.: 10/191,648

(22) Filed: Jul. 8, 2002

Related U.S. Application Data

(60) Provisional application No. 60/316,728, filed on Aug. 31, 2001.

(51) Int. Cl.[7] ..... F01N 1/12

(52) U.S. Cl. ..... 181/279; 181/280; 181/281; 181/278; 181/282; 181/270; 181/284

(58) Field of Search ..... 181/279, 280, 181/281, 278, 282, 270, 284

(56) References Cited

U.S. PATENT DOCUMENTS 1,157,256 A * 10/1915 Schmitt ..... 181/280
1,388,107 A * 8/1921 Ernst ..... 181/253
2,911,055 A * 11/1959 McDonald ..... 181/280
4,050,539 A * 9/1977 Kashiwara et al. ..... 181/280
4,683,978 A * 8/1987 Venter ..... 181/280
6,006,859 A * 12/1999 Hussaini ..... 181/227

* cited by examiner

*Primary Examiner*—Shih-Yung Hsieh
(74) *Attorney, Agent, or Firm*—Christopher L. Parmelee; Walker & Jocke

(57) ABSTRACT

An exhaust system baffling apparatus is provided. The apparatus includes a tube with at least one end that is not open. The apparatus further includes a plurality of C-shaped flanges in surrounding relation about the tube. The outer edges of the flanges have a contour which generally corresponds to a contour of an inner surface of a wall of an exhaust pipe. Opposed portions of the flanges adjacent the slits of the flanges are spread apart along the tube in a longitudinal direction. In addition, the opposed portions of the flanges adjacent the slits are angled in opposite directions and extend radially from the tube at a non-perpendicular angle with respect to the tube. At least two of the flanges include brackets adjacent the outer edges of the flanges, wherein the brackets are adapted for securing the apparatus to an interior portion of the exhaust pipe.

44 Claims, 4 Drawing Sheets

EXHAUST SYSTEM BAFFLING APPARATUS

CROSS REFERENCE TO RELATED APPLICATIONS

This application claims the benefit of U.S. Provisional Application No. 60/316,728 filed Aug. 31, 2002.

TECHNICAL FIELD

This invention relates to exhaust systems for moving vehicles. Specifically, this invention relates to an exhaust system baffling apparatus which is operative to dampen the noise level of an exhaust system and produce a unique and desirable exhaust sound.

BACKGROUND ART

Exhaust systems for moving vehicles are well known. In general, exhaust systems provide a means for dampening or muffling the noise level associated with exhaust gases exiting a combustion engine. However, different types of vehicles have different requirements for dampening the exhaust sound. For example, the object of racing vehicles is to move at a high rate of speed and win races. Because exhaust systems may limit the horsepower of an engine, racing vehicles often employ exhaust systems which minimize any loss of horsepower. As a result, racing exhaust systems tend to be excessively loud. On the other hand, passenger automobiles are designed to have a relatively low noise level for the exhaust system and typically employ mufflers to significantly dampen exhaust sounds. Other types of vehicles, such as sports cars, are often configured to have an exhaust sound with a noise level that is between the average automobile and the professional racing car.

Sports car enthusiasts often like to emphasize or "show off" their exhaust systems. One method of emphasizing an exhaust system is to mount exhaust pipes in locations that are readily viewable. For example, many "muscle cars" have exhaust pipes mounted on each side of the vehicle. Such side-mounted pipes may include a chromed outer surface to further emphasize the appearance of the exhaust system. Another method of emphasizing an exhaust system is to enhance the audible characteristics of the exhaust system. Such enhancements to the sound of an exhaust system may include raising the noise or volume level of the exhaust. Other enhancements may include changing the tone or range of tones of the exhaust system. For example, exhaust systems for "muscle" cars have been modified to produce deep, low frequency sounds. A deep sounding exhaust system is often intended to project to the listener that the car has a large and powerful engine. In addition, some exhaust sounds have such distinct qualities that manufacturers, such as Harley Davidson, have applied for trademark protection for the exhaust sounds of their vehicles.

For sports cars, various configurations of side pipe exhaust systems are available. However, the diversity of sounds produced by such systems is limited. As car enthusiasts desire methods of distinguishing their cars from the majority of other cars, there exists a need for an exhaust system which provides a unique sound that is deep in tone and dampened to meet legal and/or race track noise limitations.

Car enthusiasts often race their cars as a hobby. However, unlike their professional counterparts, car enthusiasts often require their cars to be used for general transportation in addition to racing. Thus there further exists a need for an exhaust system which both dampens the exhaust sounds to levels that are acceptable for general transportation needs, but minimizes the degradation of the power of the vehicle engine caused by restrictions to the flow of gases in the exhaust system.

Many modifications to exhaust systems require the replacement of large portions of the existing exhaust system to achieve the desired look, sound and performance for the vehicle. Unfortunately, such modifications may require custom bending of exhaust pipe and welding. Such modifications are both labor intensive and expensive. Thus, there exists a need for a method of modifying the sound and performance characteristics of an exhaust system, which can be performed relatively easily and quickly without the need for welding.

DISCLOSURE OF INVENTION

It is an object of an exemplary form of the present invention to provide an exhaust system for a vehicle.

It is a further object of an exemplary form of the present invention to provide an exhaust system which has a unique sound that is deep in tone.

It is a further object of an exemplary form of the present invention to provide an exhaust system with a maximum volume level which is acceptable for public street transportation purposes.

It is a further object of an exemplary form of the present invention to provide an exhaust system which reduces the exhaust system sound volume while minimizing degradation of engine power.

It is a further object of an exemplary form of the present invention to provide a method of modifying a pre-existing exhaust system to produce a unique exhaust sound that is deep in tone.

It is a further object of an exemplary form of the present invention to provide a method of modifying a pre-existing exhaust system to produce a maximum sound volume which is acceptable for public street transportation purposes.

It is a further object of an exemplary form of the present invention to provide a method of modifying a pre-existing exhaust system to produce an acceptable sound volume and to minimize degradation of engine power.

Further objects of exemplary forms of the present invention will be made apparent in the following Best Modes for Carrying Out Invention and the appended claims.

The foregoing objects are accomplished in an exemplary embodiment by an exhaust system baffling apparatus mounted within the side exhaust pipes of a vehicle. The baffling apparatus may include an elongated tube with an exhaust gas blocking portion, such as a cap or other sealing device, mounted to the forward end of the tube. The exhaust gas blocking portion is operative to direct exhaust gases to flow outside the tube rather than through the tube.

The baffling apparatus may further include a plurality of equally spaced flanges in surrounding relation around the tube. In the exemplary embodiment of the present invention the flanges have an outer edge with a rounded contour that corresponds to the inner circular contour of an exhaust pipe. The flanges may be in the form of a ring with a centrally located aperture and a radially extending slit. The slit extends from the aperture to an outer edge of the flange to give the flanges a C-shaped configuration. When mounted to the tube, the portions of each flange opposite the slit may extend radially from the tube and may be generally perpendicular to the tube. However, the opposed portions of each flange adjacent the slit may be curved generally away from each other and radially extend from the tube at non-perpendicular angles. For example, in an exemplary embodiment the edges of the flanges formed by the slits may extend in the radial direction at about 60 to 70 degree angles with respect to the longitudinal axis of the tube.

In an exemplary embodiment the C-shaped flanges may be formed by cutting a circular ring with a centrally located elliptical aperture and with a radial slit from a planar piece of sheet metal. The opposed ends of the circular piece of sheet metal may then be bent apart, such that one portion of the ring extends below and a second portion of the ring extends above the original plane of the ring. The flanges may be welded to the tube in a predetermined relationship along the tube with the flanges being equally spaced apart. In an exemplary embodiment all of the flanges may be orientated in the same direction with respect to the tube. In addition, the flanges may be positioned along the tube with gaps between adjacent flanges. In further exemplary embodiments the flanges may be progressively angularly offset from each other. For example, rather then having each slit of each flange being aligned, each flange may be positioned at a different angular position around the tube.

In an exemplary embodiment at least two of the flanges include a bracket member. The brackets are used to secure the apparatus to the inside of a side exhaust pipe in an orientation in which the closed or capped end of the tube faces the headers of the engine. To mount the apparatus to an exhaust pipe, the apparatus may be placed adjacent the outside surface of the pipe. Holes may then be marked and drilled through the exhaust pipe at locations which correspond to the brackets of the apparatus. The apparatus may then be inserted through one end of the exhaust pipe, such that the holes in the brackets are aligned with the holes through the exhaust pipe. Bolts may then be inserted through the holes in the pipe and the brackets to secure the apparatus within the exhaust pipe. In one exemplary embodiment at least one of the brackets may include threaded portions, such as a weld nut, to receive a bolt In alternative exemplary embodiments the flanges may have other shapes, depending on the sound characteristics and baffling characteristics desired for the exhaust system. For example, an alternative shape for the flanges may include a spiral shape. In further exemplary embodiments the tube may include one continuous spiral-shaped flange which extends in surrounding relation along all or a portion of its length. In other exemplary embodiments, differently shaped flanges or flanges orientated in different directions may be attached to the tube to produce different sounds and performance characteristics of the exhaust system.

In further exemplary embodiments of the invention, the acoustical and dampening characteristics of the apparatus may be modified by perforating the tube and/or flanges with a plurality of relatively small holes. In addition, the acoustical and dampening characteristics of the apparatus may further be modified by placing relatively short slits through the flanges which do not extend all the way between the outer edge of the flanges and the aperture of the flanges.

BEST MODES FOR CARRYING OUT INVENTION

Figure 1:
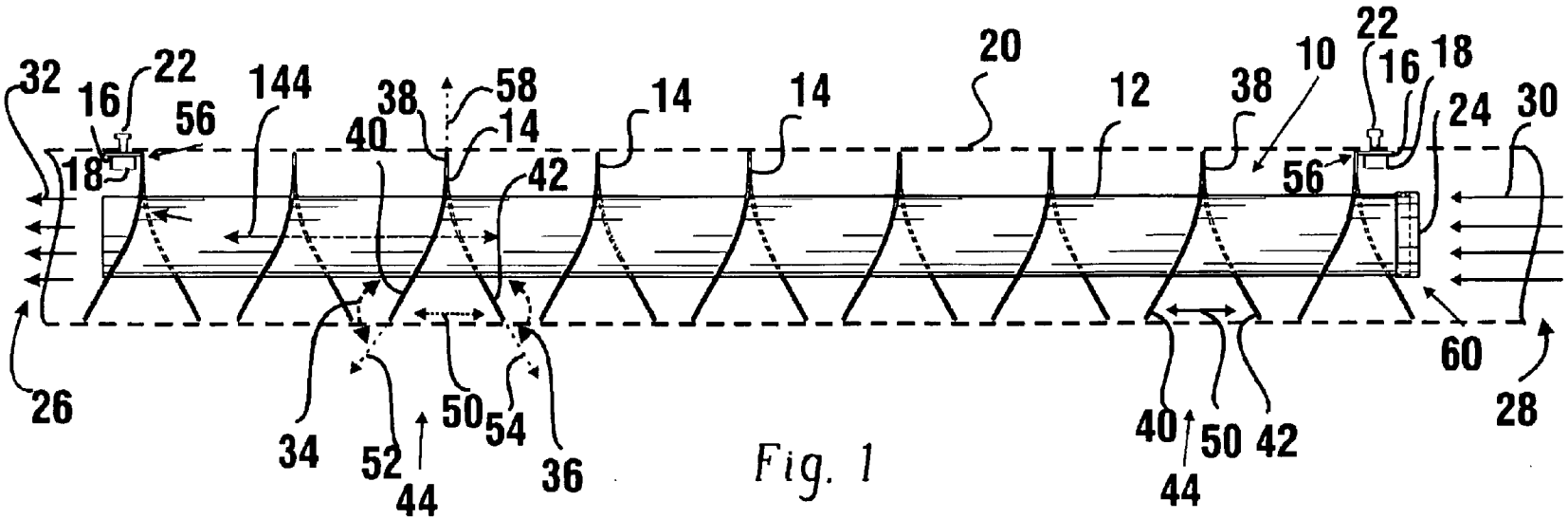
FIG. 1 is a top plan view of an exemplary embodiment of an exhaust baffling apparatus of the present invention.

Referring now to the drawings and particularly to FIG. 1, there is shown therein a top plan view of an exhaust baffling apparatus 10 of an exemplary embodiment. The exemplary embodiment of the apparatus is adapted to be mounted within the interior portion of an exhaust pipe 20 of a vehicle with a combustion engine. When mounted within an exhaust pipe 20 in fluid communication with the headers of the engine, exhaust gases 30, 32 are operative to flow through the exhaust pipe adjacent the apparatus 10. The exemplary embodiment of the baffling apparatus 10 may be operative to both muffle the exhaust sound caused by the exhaust gas flows 30, 32 and produce a unique deep rumble tone.

For example, automobiles such as a General Motors 1967 Model Corvette, may include two side exhaust pipes with about 4 inch diameters. Exemplary embodiments of the baffling apparatus of the present invention may be adapted to slide within each of the side exhaust pipes of the vehicle and be rigidly mounted to the inside walls of the side exhaust pipes. With the baffling apparatus mounted within both side pipes, the acoustical characteristics of the exhaust sound made by the vehicle may be both muffled and changed to a unique and distinctive tone.

Figure 3:
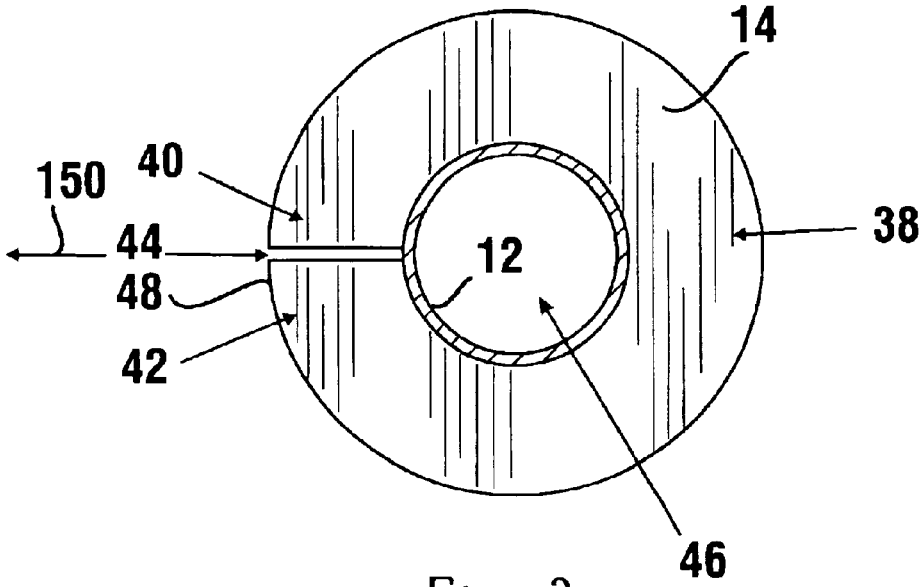
FIG. 3 is a cross-sectional view of the exhaust baffling apparatus.

An exemplary embodiment of the baffling apparatus 10 includes a tube 12. A plurality of flanges 14 may be mounted in surrounding relation about the tube 12. As shown in FIG. 3, a flange 14 may include a generally C-shaped configuration. The flange may include a centrally located aperture 46 and a radially oriented slit 44 which radially extends from the aperture 46 to an outside edge 48 of the flange 14. The aperture may have a size which is operative to accept the tube 12 therethrough. In an exemplary embodiment of the present invention the flanges 14 and the tube may be comprised of a low alloy steel. However, in alternative exemplary embodiments the flanges and tube may be comprised of other materials including a high alloy or stainless steel, or any other material which is operative to withstand the pressures, heat and vibrations associated with an exhaust system of a combustion engine. In an exemplary embodiment the flanges 14 may be welded to the tube 12. However, in alternative exemplary embodiments the flanges may be formed integral with the tube, such as with a molding or casting process.

The flanges 14 may include opposed portions 40 and 42 adjacent the slit 44. As shown in FIG. 1, these portions 40 and 42 may be spread apart a predetermined distance 50 in parallel with the longitudinal axis 144 of the tube 12 and may be angled in opposite directions 52, 54. As a result, the opposed portions 40 and 42 of the flanges 14 have angles 34 and 36 which may not be perpendicular to the longitudinal axis 144 of the tube. However, in an exemplary embodiment the portions of the flanges 38 opposite the slit 44 may generally extend from the tube in a radial direction 58 which is perpendicular to the tube. In an exemplary embodiment, the portions 40, 42 are spread apart a distance 50 which is operative to produce angles 34, 36 which range between from about 60 degrees to 70 degrees with respect to the longitudinal axis of the tube. To dampen the exhaust sound sufficiently for general transportation uses on public streets, exemplary embodiments of the baffling apparatus may include at least six of these described flanges mounted on a tube, where the end of the tube closest to the headers of the engine may be closed.

Exemplary embodiments may be adapted for cars, trucks, or any vehicle that includes a combustion engine. For example, in a vehicle that includes a 4 inch exhaust pipe, an exemplary embodiment of the present invention adapted for such an exhaust pipe may further include a tube with about a 30 inch length and about a 1¾ inch diameter. The tube may include about 9 flanges with outer diameters that about correspond to the inner diameter of the 4 inch exhaust pipe. The gap between adjacent flanges may be about ⅝ inch.

For a vehicle, such as a truck that may include a 6 inch diameter exhaust pipe, the exemplary invention may include a tube with about a 67 inch length and about a 2 inch diameter. The tube may further include about 12 flanges with outer diameters that about correspond to the inner diameter of the 6 inch exhaust pipe. The gap between adjacent flanges may be about 1 inch. In these exemplary embodiments the flanges may be generally equally spaced apart in a generally uniform orientation to produce a muffled exhaust sound with a deep rumble tone. Each of the flanges may also be generally aligned at the same angular positions with respect to the tube. However, in other exemplary embodiments the flanges may be orientated at different angular positions around the tube.

For example, in alternative exemplary embodiments, the slit of each flange may be aligned at different angular positions around the tube with respect to the slits of the other flanges. As shown in FIG. 3, the radial slit 44 of a flange corresponds to the radially oriented space between the opposed portions 40 and 42. Although, as shown in FIG. 1, the slit 44 is relatively wide as a result of the portions 40 and 42 of the flanges being spread apart, from the perspective shown in FIG. 3 each slit includes a radial orientation 150 which may be positioned at different angular positions around the tube 12.

Figure 5:
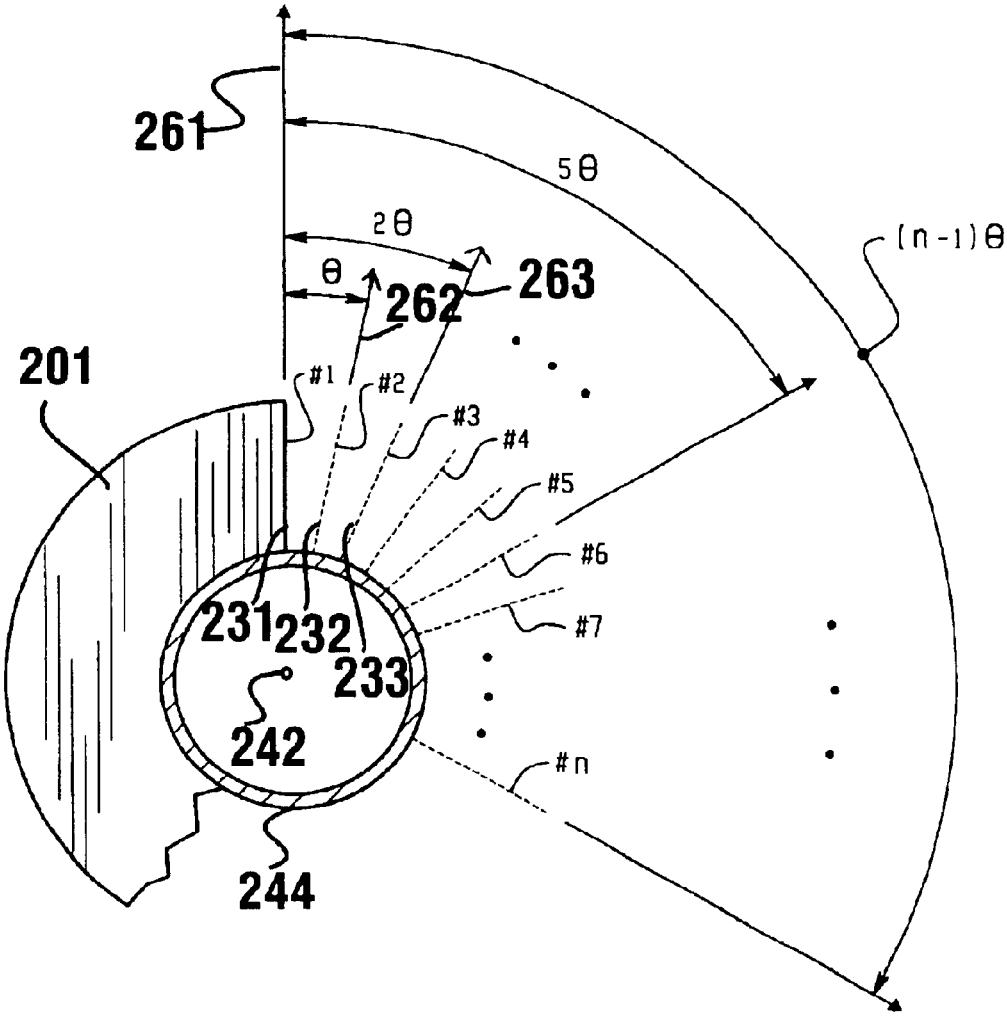
FIG. 5 is a schematic view showing flanges mounted at different angular positions around the tube of the apparatus.

For example, FIG. 5 shows a cross-section view of the apparatus facing into the longitudinal axis 242 of the tube 244. As shown in this view, the radial orientation 261 of a slit 231 in one flange 201 with respect to the tube 244 can be seen relative the slits 232, 233 of adjacent flanges. Here, first flange 201 may be mounted with its slit 231in a first radial direction 261. The second flange adjacent the first flange may be mounted such that its slit 232 is orientated in a second radial direction 262 that is angular offset from the first slit 231 by a predetermined angle θ. A third flange may be mounted such that its slit 233 is oriented in a third radial direction 263 that is angularly offset from the first slit 231 by about double the predetermined angle θ. Thus, in an exemplary embodiment each subsequent flange (n) may be angular offset by (n−1)*θ relative the first flange. An exemplary embodiment of the apparatus shown in FIG. 5, for example, may have a predetermined angle of about 6 degrees. As a result, the radial direction of a slit of each flange may be angularly separated by about 6 degrees from the radial directions of slits of adjacent flanges immediately in front of and/or behind the flange.

In the exemplary embodiment shown in FIG. 5, the radial directions of the flanges progress around the tube in a uniform spiral formation. In other exemplary embodiments, the flanges may be angular offset from each other at increasingly larger angles or decreasingly smaller angles. Further, alternating sets of flanges may have slits positioned in different angular orientations with respect to other sets of flanges. In exemplary embodiments, different patterns for orientating the positions of the slits may be used to achieve different acoustic, dampening and performance characteristics for the apparatus.

In addition, alternative exemplary embodiments may have less or more of the flanges and may have flanges which radially extend from the tube at other non-perpendicular angles. In alternative exemplary embodiments, the tube dimensions may be smaller or larger depending on the diameter and length of the exhaust pipe. In other exemplary embodiments, the end of the pipe closest to the headers of the engine may be only partially closed with a small aperture remaining that is smaller than the inner diameter of the tube. Further, in other exemplary embodiments the flanges may be positioned with or without gaps between edges and may be positioned such that the flanges partially overlap.

In an exemplary embodiment, at least two of the flanges may include brackets 16 adjacent the outer edges 56 of the flanges. The brackets 16 may be adapted for securing the apparatus to an interior portion of the exhaust pipe 20. To assist in the mounting of the apparatus, the brackets 16 may include a threaded portion 18, such as a weld nut, which is operative to receive a fastener 22, such as a threaded bolt. In an exemplary embodiment, brackets may be in operative connection with the portion 38 of the flanges opposed from the slits 44.

Figure 6:
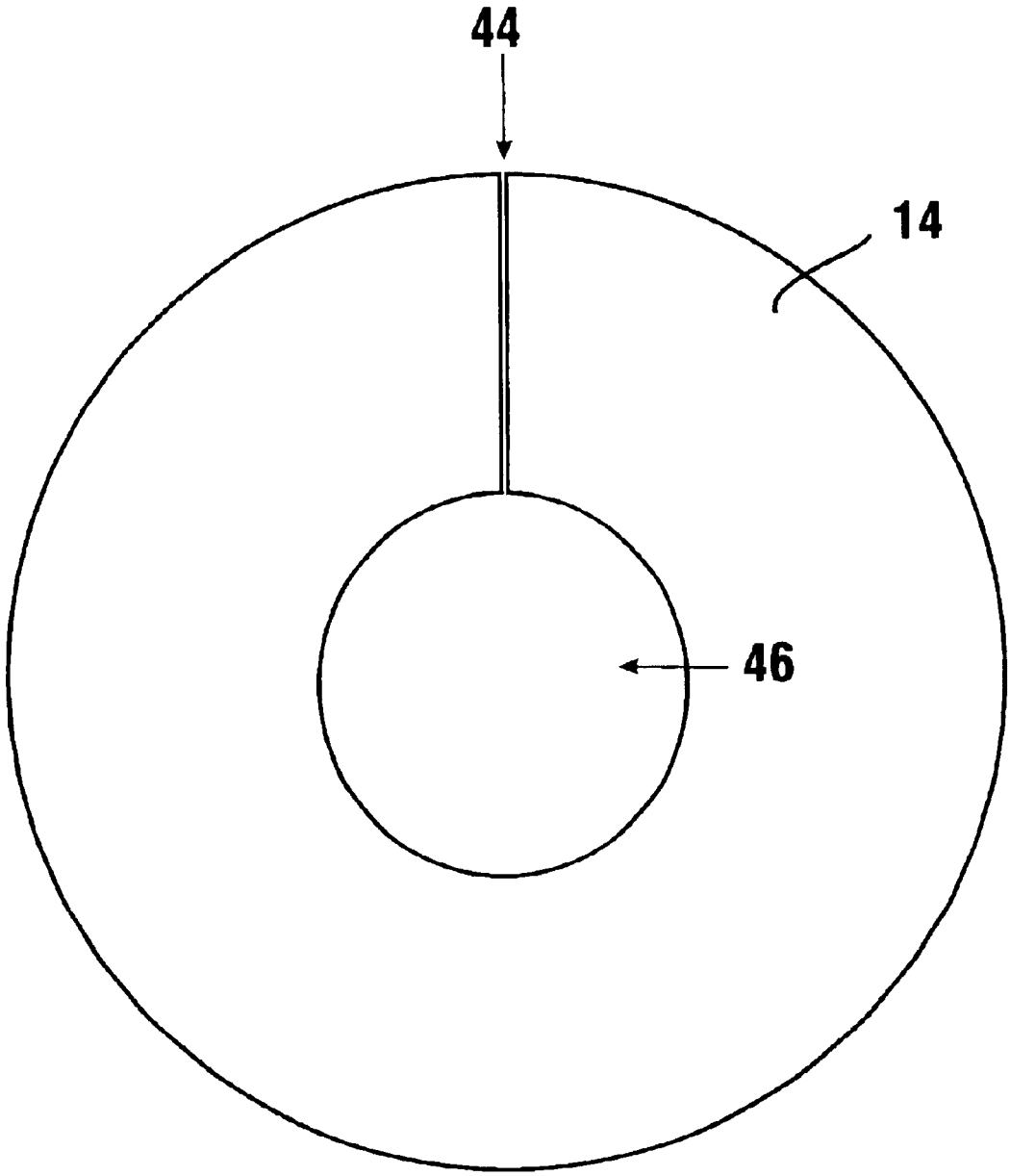
FIG. 6, shows a plan view of a flange in a planar configuration prior to being bended into a non-planar configuration.

In an exemplary embodiment, the flanges may be fabricated from planar sheet metal stock. This may be achieved by cutting rings with an outer contour which generally corresponds to the inner diameter of the exhaust pipe. As shown in FIG. 6., the flanges 14 may further be cut to have the centrally located elliptical aperture 46. The minor axis of the elliptical aperture may have a length which generally corresponds to the outer diameter of the tube that the flanges will be mounted thereon. The major axis of the elliptical aperture generally may have a size that is sufficiently large to generally correspond to the outer diameter of the tube after the flanges are bended. The flanges may be cut to include a slit 44 which radially extends from the aperture to the edge of the ring. The slit may be cut through the ring to be generally aligned with the major axis of the elliptical aperture. In further exemplary embodiments, the outer contour of the rings may be cut to include a rectangular extension located opposite the slit. The rectangular extension may be bended at 90 degrees to produce an integral bracket for mounting the apparatus to the exhaust pipe.

The resulting planar C-shaped flange may be modified to have the non-planar configuration shown in FIGS. 1–4, by bending apart the opposed portions 40, 42 of the flange that are adjacent the slit 44 in generally opposite axial directions. As a result, opposed portions 40 and 42 are oppositely angled above and below the original plane of the flange. The resulting non-planar C-shaped flange may be welded to the tube at spaced apart intervals along the tube.

When mounted within an exhaust pipe, the front end 60 of the apparatus may be intended to be orientated upstream with respect to the flow of exhaust gases 30 and faces the input end 28 of the exhaust pipe. The input end 28 is the portion of the exhaust pipe 20 connected closest to the combustion engine and may be directly connected to the headers of the engine or may be connected to other exhaust devices, such as a catalytic converter. The exhaust gases 32 pass out of the output end 26 of the exhaust pipe 20 after flowing through the exhaust pipe and flowing adjacent the baffling apparatus 10. In some exemplary embodiments of exhaust pipes, the output end 26 of the exhaust pipe may include a curved portion to direct hot exhaust gases 32 away from the vehicle.

Figure 4:
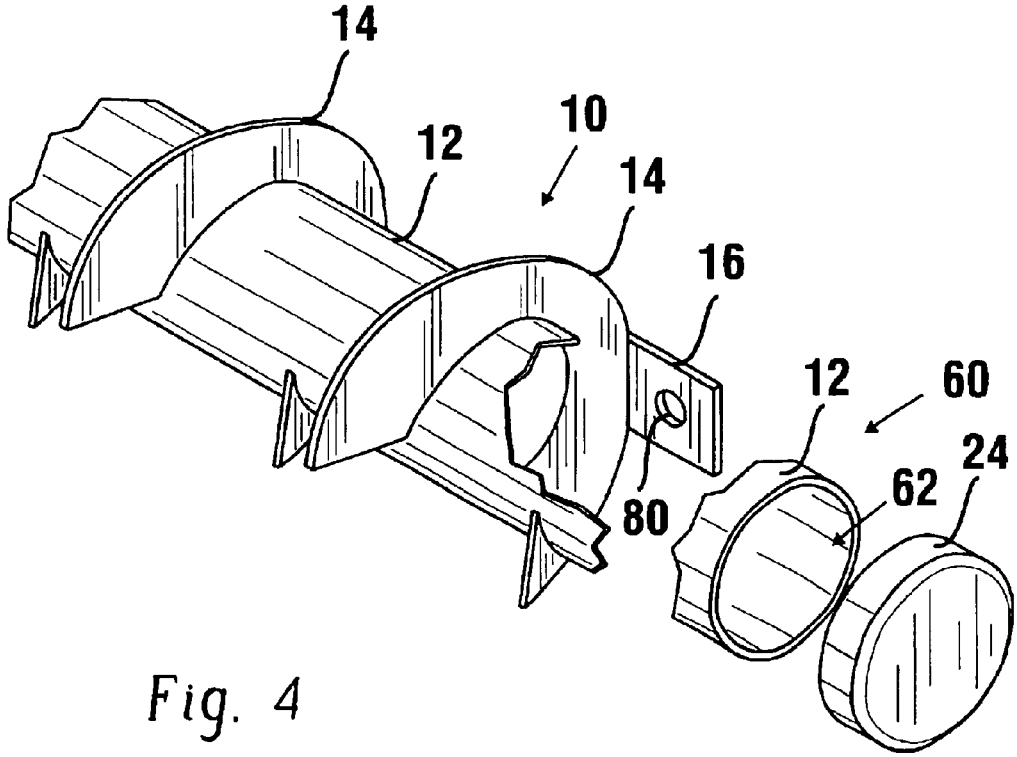
FIG. 4 is a perspective view of the front end of the exhaust baffling apparatus.

FIG. 4 shows a perspective and cut-away view of the front end 60 of the baffling apparatus 10. To achieve the desired muffling and audible characteristics, the opening 62 to the tube 12 at the front end 60 of the apparatus may be completely or partially closed off to prevent exhaust gases from passing through the tube 12. As a result, the exhaust gases may be directed to flow around the outside of the tube and across the flanges 14. In an exemplary embodiment an exhaust gas blocking portion 24, such as a cap, may be provided with the tube 12 at the front end 60 of the apparatus to at least partially close the opening 62 to the tube 12. In exemplary embodiments, the exhaust gas blocking portion 24 may be tapered with a concave and/or conical shape to more efficiently direct exhaust gases around the outside of the tube 12. In an exemplary embodiment the exhaust gas blocking portion may include a cap that is operative to substantially seal the end of the tube. In other exemplary embodiments the exhaust gas blocking portion may not completely seal the end of the tube. Rather, the exhaust gas blocking portion may direct portions of the exhaust gases to flow outside the tube while allowing other portions of the exhaust gases to flow through the tube. For example, in one exemplary embodiment the exhaust gas blocking portion may include a cap with a plurality of apertures therethrough. In other exemplary embodiments the gas blocking portion may include the walls of the end of the tube being crimped or otherwise tapered together to completely or partially close the end of the tube.

Figure 2:
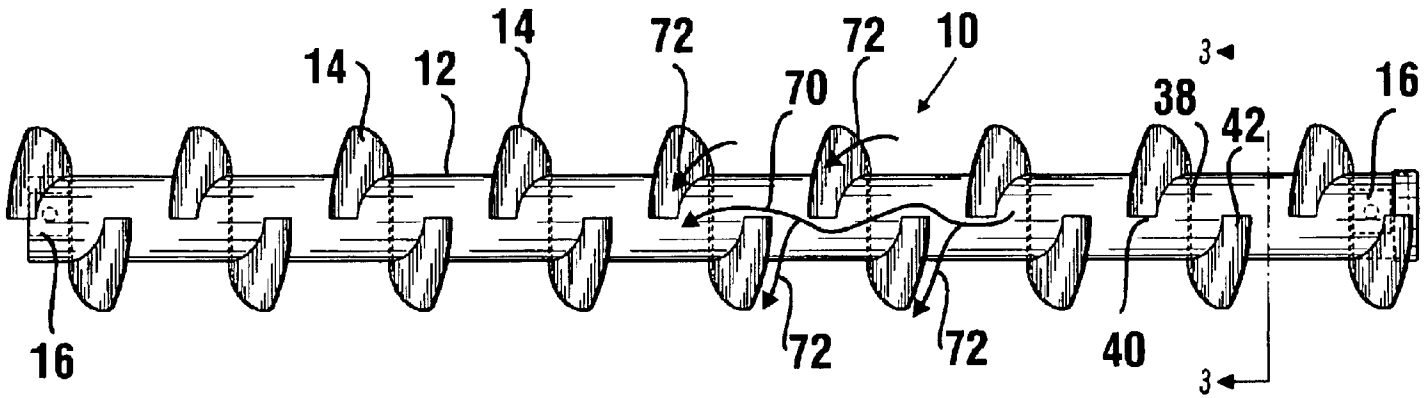
FIG. 2 is a side plan view of an exemplary embodiment of an exhaust baffling apparatus of the present invention.

FIG. 2 shows a side view of the exemplary embodiment of the baffling apparatus 10. It is believed that the configuration and orientation of the flanges in the exemplary embodiment of the present invention are operative to direct exhaust gases to flow, both in a generally longitudinal direction 70 between the slits of the flanges and in a generally circular flow 72 around the tube. The resulting gas flows adjacent the described exemplary embodiment of the present invention are operative to produce a muffled exhaust sound with a unique and desirable deep rumble tone.

In exemplary embodiments of the apparatus with flanges angular offset as shown in FIG. 5, significant acoustical dampening is achieved with minimal degradation of horse power compared to the use of a hollow exhaust pipe.

In further alternative exemplary embodiments, the acoustical characteristics may be modified by perforating the flanges and/or the tube with small holes or slits. In further exemplary embodiments the acoustical characteristics may be modified by changing the curvature of the flanges to have a spiral or helical curvature. In further exemplary embodiments, the acoustical characteristics may be modified by increasing or decreasing the gaps between flanges. In other exemplary embodiments the acoustical characteristics may be modified by having single or multiple spiral flanges that include multiple loops around the tube.

Although alternative exemplary embodiments of the present invention may be welded to the inside of an exhaust pipe, in the described exemplary embodiment the brackets enable the baffling apparatus to be easily installed and removed from an exhaust pipe with fasteners. The present exemplary invention includes a novel method of installing the exemplary embodiment of the baffling apparatus in a preexisting exhaust pipe. This method includes placing the described baffling apparatus next to, and in parallel with, an exhaust pipe such that the brackets are adjacent an outside surface of the wall of the exhaust pipe. To assist in aligning the baffling apparatus and the exhaust pipe, both may be placed on a level surface.

As shown in FIG. 4, the brackets 16 may include holes 80. By placing a marking device in the holes, marks may be produced on the outside surface of the wall of the exhaust pipe to mark the locations of the holes of the brackets. The baffling apparatus may then be removed from the exhaust pipe and holes may be drilled through the wall of the exhaust pipe at the marks. The baffling apparatus is placed in the interior portion of the exhaust pipe by sliding and/or twisting the baffling apparatus through one end of the exhaust pipe. In the exemplary embodiment, the end of the tube that is not open is positioned upstream, with respect to the exhaust gas flow, to face the end of the exhaust pipe mounted closest to the engine.

The baffling apparatus is next positioned within the exhaust pipe to align the holes of the brackets with the holes drilled in the exhaust pipe. Fasteners may be mounted within the holes of the brackets and the holes drilled in the exhaust pipe to rigidly secure the apparatus to the exhaust pipe. The fasteners may include, for example, nuts, bolts and lock washers, or any other fastening device which is operative to securely fix the baffling apparatus to the exhaust pipe. As shown in FIG. 1, one or more of the brackets 16 may further include an integral threaded portion 18, such as a weld nut, which is operative to receive a threaded nut 22 in a cooperatively locking engagement.

Exhaust pipes may include one or more obstructions, such as excess welding material, indentations, bends, or other projections within the exhaust pipe which hinder the insertion of the baffling apparatus. As a result, the baffling apparatus may need to be rotated with respect to the exhaust pipe to pass one or more of the flanges around the obstruction within the exhaust pipe. In addition, one or more of the flanges may need to be shortened, such as by grinding, for example, to enable the baffling apparatus to slide completely within the exhaust pipe.

Thus, the new exhaust system baffling apparatus achieves one or more of the above stated objectives, eliminates difficulties encountered in the use of prior devices and systems, solves problems and attains the desirable results described herein.

In the foregoing description certain terms have been used for brevity, clarity and understanding, however no unnecessary limitations are to be implied therefrom because such terms arc used for descriptive purposes and are intended to be broadly construed. Moreover, the descriptions and illustrations herein are by way of examples and the invention is not limited to the exact details shown and described.

In the following claims, any feature described as a means for performing a function shall be construed as encompassing any means known to those skilled in the art to be capable of performing the recited function, and shall not be limited to the features and structures shown herein or mere equivalents thereof.

Having described the features, discoveries and principles of the invention, the manner in which it is constructed and operated, and the advantages and useful results attained; the new and useful structures, devices, elements, arrangements, parts, combinations, systems, equipment, operations, methods and relationships are set forth in the appended claims.

I claim:

1. An exhaust system baffling apparatus comprising:

a tube;

a plurality of radially extending flanges mounted in surrounding relation about the tube, wherein the outer edges of the flanges have a contour which generally corresponds to a contour of an inner surface of a wall of an exhaust pipe, wherein each flange includes a radial slit which extends from the tube to the outer edge of the flange, wherein opposed portions of the flanges adjacent the slits of the flanges are spread apart in opposite directions that are parallel to a longitudinal axis of the tube, wherein the opposed portions of the flanges adjacent the slits are angled in opposite directions and extend radially from the tube at non-perpendicular angles with respect to the tube, wherein the slits of at least two of the flanges are orientated at different angular positions around the longitudinal axis of the tube, wherein at least two of the flanges include brackets adjacent the outer edges of the flanges, wherein the brackets are adapted for securing the apparatus to an interior portion of the exhaust pipe.

2. The apparatus according to claim 1, wherein the portions of the flanges opposite the slits extend radially from the tube at an angle that is about perpendicular to the tube.

3. The apparatus according to claim 1, wherein at least six flanges are mounted in surrounding relation about the tube.

4. The apparatus according to claim 1, wherein at least one end of the tube includes an exhaust gas blocking portion that is operative to direct at least portions of the exhaust gases to flow outside the tube.

5. The apparatus according to claim 4, wherein the exhaust gas blocking portion includes a cap, wherein the cap substantially seals the at least one end of the tube.

6. The apparatus according to claim 1, further comprising the exhaust pipe in surrounding relation about the tube and flanges, wherein the two brackets are mounted to the inner wall of the exhaust pipe.

7. The apparatus according to claim 6, wherein the exhaust pipe includes two holes through the wall of the exhaust pipe in locations adjacent the brackets, and further comprising two fasteners positioned within the holes, wherein the fasteners are operative to secure the brackets to the wall of the exhaust pipe.

8. The apparatus according to claim 7, wherein the exhaust pipe includes an input end that is adapted for connection with an exhaust portion of an engine and is operative to direct exhaust gases from the engine into the exhaust pipe, wherein the exhaust pipe further includes an output end that is operative to release exhaust gases flowing through the exhaust pipe, wherein at least one end of the tub includes an exhaust gas blocking portion that is operative to direct exhaust gases to flow outside the tube, wherein the at least one end of the tube is orientated to face the input end of the exhaust pipe.

9. The apparatus according to claim 1, wherein at least one of the brackets includes a threaded portion that is operative to cooperatively receive a fastener.

10. The apparatus according to claim 1, wherein the slits of at least two of the flanges are orientated at a common angular position with respect to the longitudinal axis of the tube.

11. The apparatus according to claim 1, wherein the slits of the flanges are oriented at different angular directions in a spiral progression around at least a portion of the tube.

12. The apparatus according to claim 1, wherein a first one of the flanges includes a slit oriented in a first radial direction with respect to the longitudinal axis of the tube, wherein a second one of the flanges adjacent the first one of the flanges is oriented in a second radial direction with respect to the longitudinal axis of the tube which is angularly offset from the first radial direction by a predetermined angle, wherein a third one of the flanges adjacent the second one of the flanges is orientated in a third radial direction with respect to the longitudinal axis of the tube which is angularly offset from the first radial direction by about double the predetermined angle.

13. A method of mounting the exhaust system baffling apparatus recited in claim 1 comprising:

a) drilling holes through the wall of the exhaust pipe in positions that correspond to the relative positions of holes in the brackets of the apparatus;

b) inserting the apparatus within an interior portion of the exhaust pipe;

c) aligning the holes of the brackets with the holes drilled in the exhaust pipe; and d) mounting fasteners through the holes drilled in the exhaust pipe to engage with the brackets and rigidly secure the apparatus to the exhaust pipe.

14. The apparatus according to claim 1, wherein at least portions of the opposed portions of each flange adjacent the slit are spaced apart in a direction that is perpendicular to the longitudinal axis of the tube.

15. An exhaust baffling apparatus comprising:

a plurality of flanges, wherein each of the flanges includes a centrally positioned aperture and a slit that extends through the flange from the aperture to an outer edge of the flange, wherein each flange includes a first edge portion that bounds a first side of the slit, wherein each flange includes a second edge portion that bounds a second side of the slit opposite the fist side of the slit; and a tube positioned through the apertures of the flanges wherein each flange is rigidly mounted in surrounding relation about the tube, wherein the opposed first and second edge portions which bound the slits of each flange extend outwardly from the tube in opposed directions and at angles that are acute with respect to the longitudinal axis of the tube, wherein the slits of at least two of the flanges are orientated at different angular positions with respect to the longitudinal axis of the tube.

16. The apparatus according to claim 15, wherein portions of the flanges opposite the slits extend radially from the tube at an angle that is about perpendicular to the tube.

17. The apparatus according to claim 15, wherein the flanges are mounted at generally equally spaced intervals along the tube, wherein the flanges are spaced apart with a generally uniform gap between adjacent flanges.

18. The apparatus according to claim 15, further comprising:

an exhaust pipe in surrounding relation about the tube and the plurality of flanges.

19. The apparatus according to claim 18, wherein at least two of the flanges include brackets adjacent an outer edge of the flanges, wherein the exhaust pipe includes two holes through the wall of the exhaust pipe in locations adjacent the brackets, and further comprising two fasteners positioned within the holes, wherein the fasteners are operative to secure the brackets to the wall of the exhaust pipe.

20. The apparatus according to claim 19, wherein at least one of the brackets includes a threaded portion that is operative to cooperatively receive one of the fasteners.

21. The apparatus according to claim 15, wherein the slits of at least three consecutive flanges are oriented at different angular positions in a spiral progression around at least a portion of the tube.

22. The apparatus according to claim 15, wherein at least portions of the opposed first and second edge portions which bound the slit of each flange are spaced apart in a direction that is perpendicular to the longitudinal axis of the tube.

23. A method of producing an exhaust baffling apparatus comprising:

a) cutting a plurality of generally circular flanges from at least one planar sheet metal, wherein each flange is cut to include a centrally positioned generally elliptical aperture and a radial slit that extends from the aperture to an edge of the flange, wherein the radial slit is generally aligned with the major axis of the elliptical aperture;

b) bending opposed ends of each flange apart at the silt in opposite and transverse directions with respect to the original plane of the flange; and c) mounting the flanges in surrounding relation about a tube.

24. The method according to claim 23, further comprising:

d) forming brackets in operative connection with at least two of the flanges, wherein each bracket includes a portion that is operative to cooperatively receive a fastener.

25. The method according to claim 24, further comprising:

e) providing an exhaust gas blocking member adjacent a first end of the tube, wherein the exhaust gas blocking member is operative to direct exhaust gases to flow outside the tube; and f) mounting the tube and flanges within an exhaust pipe, wherein the first end of the tube faces an end of the exhaust pipe that is adapted for being mounted closer to a combustion engine than the opposite end of the exhaust pipe.

26. The method according to claim 23, wherein in step (c) the flanges are mounted to the tube such that portions of the flanges opposite the slits extend radially from the tube at an angle that is about perpendicular to the tube, wherein opposed portions of the flanges adjacent the silts are angled in opposite directions and extend radially from the tube at a non-perpendicular angle with respect to the tube.

27. The method according to claim 23, wherein step (c) includes mounting at least six flanges in surrounding relation about the tube.

28. The method according to claim 23, wherein step (c) includes mounting the flanges such that the slits are orientated at a common angular position with respect to the longitudinal axis of the tube.

29. The method according to claim 23, wherein step (c) includes mounting the flanges such the slits are orientated at different angular positions around the longitudinal axis of the tube.

30. The method according to claim 29, wherein step (c) the radial slits are orientated at different angular positions in a spiral progression around at least a portion of the tube.

31. An exhaust baffling apparatus made by the process comprising the steps recited in claim 23.

32. A method of producing an exhaust baffling apparatus comprising:

a) cutting a plurality of flanges from at least one sheet of metal, wherein each flange is cut to include a centrally positioned aperture and a slit that extends through the flange from the aperture to an outer edge of each flange, wherein each flange includes a first edge portion that bounds a first side of the slit, wherein each flange includes a second edge portion that bounds a second side of the slit opposite the first side of the slit, wherein the apertures of each flange are elongated;

b) bending at least one of the first and second edge portions of each flange relative to the other edge portion in at least one direction that is perpendicular with respect to an original plane of the flange; and c) mounting the flanges in surrounding relation about a tube.

33. The method according to claim 32, wherein step (c) includes mounting at least six of the flanges to the tube.

34. The method according to claim 32, and further comprising:

d) forming brackets in operative connection with at least two flanges;

e) drilling holes through a wall of an exhaust pipe in positions that are operative to be aligned with the brackets of the apparatus when the apparatus is inserted into the exhaust pipe;

f) inserting the apparatus within an interior portion of the exhaust pipe;

g) aligning the brackets with the holes drilled in the exhaust pipe; and h) mounting fasteners through the holes drilled in the exhaust pipe to engage with the brackets and rigidly secure the apparatus to the exhaust pipe.

35. The method according to claim 34, wherein prior to step (e) further comprising:

i) placing the brackets adjacent an outside surface of the wall of the exhaust pipe; and j) producing marks on the outside surface of the wall of the exhaust pipe at the locations of the brackets, wherein in step (e) the holes in the exhaust pipe are drilled adjacent the marks.

36. The method according to claim 34, wherein the tube includes at least one end with an exhaust gas blocking portion, wherein in step (f) the at least one end of the tube with the exhaust gas blocking portion is orientated to face the end of the exhaust pipe which is adapted for mounting closest to a combustion engine.

37. The method according to claim 32, further comprising:

d) mounting the tube and plurality of flanges within an exhaust pipe.

38. The method according to claim 32, wherein in step (a) for each flange, the slit extends from the aperture to the outer edge of the flange in generally aligned relation with the first direction of elongation of the aperture.

39. The method according to claim 32, wherein in step (a) the apertures of each flange have a generally elliptical shape.

40. The method according to claim 32, wherein step (c) includes mounting the flanges such that the opposed first and second edge portions which bound the slit of each flange are orientated to extend outwardly from the tube in opposed directions and at angles that are acute with respect to a longitudinal axis of the tube.

41. The method according to claim 40, wherein step (c) includes mounting the flanges such that the slits are orientated at a generally common angular position with respect to the longitudinal axis of the tube.

42. The method according to claim 40, wherein step (c) includes mounting the flanges such that the slits are orientated at different angular positions around the longitudinal axis of the tube.

43. The method according to claim 40, wherein step (c) includes mounting at least three of the flanges such that the slits of the at least three flanges are orientated at different angular positions in a spiral progression around at least a portion of the tube.

44. An exhaust baffling apparatus made by the process comprising the steps recites in claim 32.

* * * * *

UNITED STATES PATENT AND TRADEMARK OFFICE

CERTIFICATE OF CORRECTION

PATENT NO. : 6,796,403 B1
APPLICATION NO. : 10/191648
DATED : September 28, 2004
INVENTOR(S) : James C. Laughlin It is certified that error appears in the above-identified patent and that said Letters Patent is hereby corrected as shown below:

Column 1, line 6, replace:
"Aug. 31, 2002" with --Aug. 31, 2001--.

Column 8, line 47, replace:
"arc" with --are--.

Claim 8, Column 9, line 46, replace:
"tub" with --tube--.

Claim 23, Column 11, line 12, replace:
"silt" with --slit--.

Claim 26, Column 11, line 37, replace:
"silts" with --slits--.

Claim 29, Column 11, line 47, replace:
"such the slits" with --such that the slits--.

Claim 44, Column 12, line 65, replace:
"recites" with --recited--.

Signed and Sealed this

Fifteenth Day of January, 2008

JON W. DUDAS
*Director of the United States Patent and Trademark Office*